US009194327B2

(12) United States Patent
Hillebrecht et al.

(10) Patent No.: US 9,194,327 B2
(45) Date of Patent: Nov. 24, 2015

(54) CYLINDER LINER WITH SLOTS

(71) Applicant: General Electric Company, Schenectady, NY (US)

(72) Inventors: Michael Hillebrecht, Munich (DE); Richard John Donahue, West Bend, WI (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 0 days.

(21) Appl. No.: 14/246,301

(22) Filed: Apr. 7, 2014

(65) Prior Publication Data

US 2015/0285181 A1 Oct. 8, 2015

(51) Int. Cl.
*F02F 3/00* (2006.01)
*F02F 1/00* (2006.01)

(52) U.S. Cl.
CPC ..... *F02F 1/004* (2013.01)

(58) Field of Classification Search
CPC ..... F02F 1/004; F02F 3/00; F02F 2001/006; F02F 5/00; F02F 11/005; F02F 1/163; F16J 10/04; F16J 1/09; F16J 9/02; F16J 9/00
USPC ..... 123/193.1–193.6
See application file for complete search history.

(56) References Cited

U.S. PATENT DOCUMENTS

| | | | | |
|---|---|---|---|---|
| 6,886,504 | B2 * | 5/2005 | Johnstone | 123/41.52 |
| 7,186,072 | B2 | 3/2007 | Seitz | |
| 8,851,029 | B2 * | 10/2014 | Callahan et al. | 123/46 R |
| 2012/0186561 | A1 * | 7/2012 | Bethel et al. | 123/51 R |
| 2013/0298853 | A1 * | 11/2013 | Liu et al. | 123/41.84 |
| 2014/0109862 | A1 * | 4/2014 | Straub | 123/193.6 |
| 2014/0216425 | A1 * | 8/2014 | Callahan | 123/65 P |
| 2014/0299090 | A1 * | 10/2014 | Hofbauer | 123/193.4 |

FOREIGN PATENT DOCUMENTS

EP 2746531 A1 6/2014

* cited by examiner

*Primary Examiner* — Lindsay Low
*Assistant Examiner* — Long T Tran
(74) *Attorney, Agent, or Firm* — Fletcher Yoder, P.C.

(57) ABSTRACT

A system includes a reciprocating engine having a cylinder liner having an inner surface that defines a cavity and multiple slots disposed along a portion of the inner surface. The reciprocating engine also includes a piston disposed within the cylinder liner and configured to move between a first position and a second position. The reciprocating engine further includes a first ring disposed about the piston beneath a top land of the piston. The first ring, the top land, a first ring groove of the piston, and the inner surface of the cylinder liner define a top land cavity. The reciprocating engine also includes a second ring disposed about the piston below the first ring and a second land of the piston. The first and second rings, the second land, a second ring groove of the piston, and the inner surface of the cylinder liner define an interring cavity.

20 Claims, 3 Drawing Sheets

CYLINDER LINER WITH SLOTS

BACKGROUND

The subject matter disclosed herein relates to reciprocating engines and, more specifically, to a cylinder liner for a reciprocating engine.

A reciprocating engine (e.g., an internal combustion engine such as a diesel, gasoline, or gas engine) combusts fuel with an oxidant (e.g., air) to generate hot combustion gases, which in turn drive a piston (e.g., reciprocating piston) within a cylinder. In particular, the hot combustion gases expand and exert a pressure against the piston that linearly moves the position from a top portion to a bottom portion of the cylinder during an expansion stroke. The piston converts the pressure exerted by the combustion gases (and the piston's linear motion) into a rotating motion (e.g., via a connecting rod and a crank shaft coupled to the piston) that drives one or more loads, e.g., an electrical generator. The construction of the reciprocating engine (e.g., the cylinder and piston) can significantly impact exhaust emissions (e.g., unburned hydrocarbons) and engine efficiency. As a result, aftertreatment systems may be utilized to treat these emissions resulting in increased costs and complexity of installation and general servicing.

BRIEF DESCRIPTION

Certain embodiments commensurate in scope with the originally claimed invention are summarized below. These embodiments are not intended to limit the scope of the claimed invention, but rather these embodiments are intended only to provide a brief summary of possible forms of the invention. Indeed, the invention may encompass a variety of forms that may be similar to or different from the embodiments set forth below.

In a first embodiment, a system includes a reciprocating engine. The reciprocating engine includes a cylinder liner having an inner surface that defines a cavity. The cylinder liner includes multiple slots disposed along a portion of the inner surface. The reciprocating engine also includes a piston disposed within the cylinder liner. The piston is configured to move between a first position and a second position. The reciprocating engine further includes a first ring disposed about the piston beneath a top land of the piston. The first ring, the top land, top ring groove, and the inner surface of the cylinder liner define a top land cavity. The reciprocating engine yet further includes a second ring disposed about the piston below the first ring and a second land of the piston. The first and second rings, the second land, second ring groove, and the inner surface of the cylinder liner define an interring cavity. In the first position, the first and second rings, the top land cavity, and the interring cavity do not interface with the multiple slots. In the second position, either the first ring or the second ring and at least one of the top land cavity or the interring cavity interface with the multiple slots.

In accordance with a second embodiment, a system includes a cylinder liner for a reciprocating engine having an inner surface that defines a cavity. The cylinder liner includes multiple slots disposed along a portion of the inner surface. The cylinder liner is configured to receive a piston within the cavity. The multiple slots are disposed at a point along a longitudinal length of the cylinder liner where a cavity pressure within a first portion of the cavity of the cylinder liner above the piston is configured to be substantially equal to an interring cavity pressure of an interring cavity during an expansion stroke of the piston, the interring cavity being defined by an outer surface of the piston, first and second rings disposed about the piston, and the inner surface of the cylinder liner.

In accordance with a third embodiment, a system includes a reciprocating engine. The reciprocating engine includes a cylinder liner having an inner surface that defines a cavity, wherein the cylinder liner comprises multiple slots disposed along a portion of the inner surface. The reciprocating engine also includes a piston disposed within the cylinder liner, wherein the piston is configured to move between a first position, a second position, and a third position. The reciprocating engine further includes a first ring disposed about the piston beneath a top land of the piston, wherein the first ring, the top land, top ring groove, and the inner surface of the cylinder liner define a top land cavity. The reciprocating engine yet further includes a second ring disposed about the piston below the first ring and a second land of the piston, wherein the first and second rings, the second land, second ring groove, and the inner surface of the cylinder liner define an interring cavity. In the first position neither a first fluid within the top land cavity nor a second fluid within the interring cavity is enabled to flow into the multiple slots. In the second position the first fluid within the top land cavity is not enabled to flow into the multiple slots and the second fluid within the interring cavity is enabled to flow into the multiple slots and into a portion of the cavity below the piston. In the third position the first fluid within the top land cavity is enabled to flow into the multiple slots and into the interring cavity and is not enabled to flow into a portion of the cavity below the piston.

BRIEF DESCRIPTION OF THE DRAWINGS

These and other features, aspects, and advantages of the present invention will become better understood when the following detailed description is read with reference to the accompanying drawings in which like characters represent like parts throughout the drawings, wherein.

DETAILED DESCRIPTION

Figure 1:
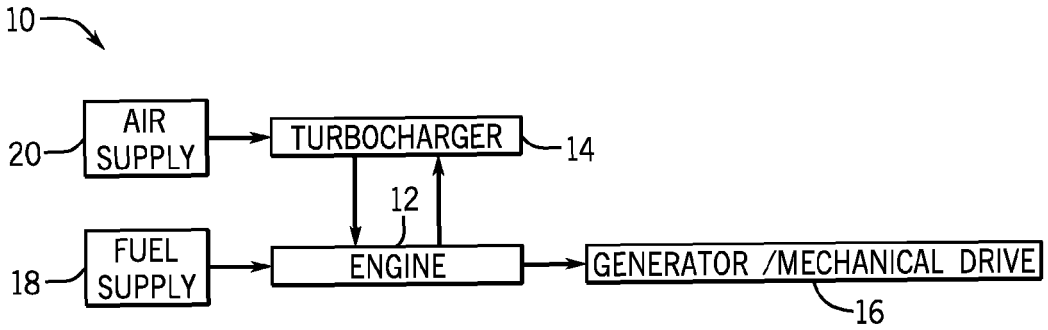
FIG. 1 is a block diagram of an embodiment of an engine driven power generation system with reduced total hydrocarbons emissions.

One or more specific embodiments of the present invention will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements.

The present disclosure is directed to systems for reducing total hydrocarbon (THC) emissions (e.g., due to unburned fuel or hydrocarbons) in reciprocating engines. In particular, embodiments of the present disclosure include a reciprocating engine that includes a cylinder liner having an inner surface that defines a cavity, where the cylinder liner include multiple slots (e.g., piston crevice scavenging control slots) along a portion of the inner surface (e.g., forming a single row disposed circumferentially along the inner surface). The slots 22 enable scavenging of unburned fuel that would otherwise be discharged during an exhaust stroke; this scavenged unburned fuel can then be utilized in a subsequent expansion stroke. The reciprocating engine includes a piston disposed within the cylinder liner, where the piston is configured to move between multiple positions (e.g., during an expansion stroke). The reciprocating engine includes a first ring (e.g., annular compression ring) disposed about the piston beneath a top land of the piston. The first ring, the top land, first ring groove, and the inner surface of the cylinder liner define a top land cavity (e.g., annular cavity). The reciprocating engine also includes a second ring (e.g., annular compression ring) disposed about the piston below the first ring and a second land of the piston. The first and second rings, the second land, second ring groove, and the inner surface of the cylinder liner define an interring cavity (i.e., annular cavity between the first and second rings). In one position (e.g., during the beginning of the expansion stroke when the pressure in the cavity above the piston is greater than an interring cavity pressure), the first and second rings, the top land cavity, and the interring cavity do not interface with the multiple slots (i.e., the slots are closed with respect to the top land cavity and the interring cavity). In another position (e.g., just subsequent to the portion of the expansion stroke where the interring cavity pressure is substantially equal to the top land cavity pressure), the second ring and the interring cavity interface with the multiple slots (i.e., the slots are open with respect to the interring cavity) enabling blowby of fluid (e.g., gases including unburned hydrocarbons) from the interring cavity, through the slots, and into the cavity below the piston towards the crank case, while the first ring and the top land cavity do not interface with the multiple slots. In a further position (e.g., during the portion of the expansion stroke where the interring cavity pressure is now substantially equal to the crankcase pressure (e.g., the portion of the cavity below the piston) and where the top land cavity pressure is greater than the interring cavity pressure), the first ring and the top land cavity interface with the multiple slots enabling the flow of fluid (e.g., unburned hydrocarbons) from the top land cavity into the interring cavity, while the second ring does not interface with the multiple slots (e.g., to block backflow). The fluid (e.g., unburned hydrocarbons) transferred or scavenged from the top ring cavity to the interring cavity during the expansion stroke may be maintained within the interring cavity during the exhaust stroke to be scavenged into the crank case during a subsequent expansion stroke. Scavenging fluid (e.g., unburned hydrocarbons) from the interring cavity into the crank case and from the top land cavity into the interring cavity during the expansion stroke may reduce the amount of unburned hydrocarbons expelled through the engine exhaust during the exhaust stroke, thus, reducing the amount of THC emissions and improving engine efficiency. As a result, the need for or size of aftertreatment systems to achieve desired engine out THC emissions may be reduced.

Turning now to the drawings and referring first to FIG. 1, a block diagram of an embodiment of engine driven power generation system 10 with reduced total hydrocarbons emissions is illustrated. As described in detail below, the disclosed engine driven power system 10 utilizes an engine 12 that includes a wall of the cylinder or a cylinder liner (e.g., disposed within the cylinder) that includes a plurality of slots that in conjunction with the existing cavities or crevices (e.g., top land cavity and interring cavity) and the pressure differentials within the cylinder liner during the expansion stroke enables a reduction in THC emissions (e.g., by scavenging unburned hydrocarbons). The engine 12 may include a reciprocating or piston engine (e.g., internal combustion engine). The engine 12 may include a spark-ignition engine or a compression-ignition engine. The engine 12 may include a natural gas engine, gasoline engine, diesel engine, or dual fuel engine. The engine 12 may be a two-stroke engine, three-stroke engine, four-stroke engine, five-stroke engine, or six-stroke engine. The engine 12 may also include any number of cylinders (e.g., 1-24 cylinders or any other number of cylinders) and associated piston and liners.

The power generation system 10 includes the engine 12, a turbocharger 14, and a generator/mechanical drive 16. Depending on the type of engine 12, the engine receives fuel 18 (e.g., diesel, natural gas, coal seam gases, associated petroleum gas, etc.) or a mixture of both the fuel 18 and a pressurized oxidant 20, such as air, oxygen, oxygen-enriched air, or any combination thereof. Although the following discussion refers to the oxidant as the air 20, any suitable oxidant may be utilized with the disclosed embodiments. The fuel 18 or mixture of fuel 18 and pressurized air 20 is fed into the engine 12. The engine 12 combusts the mixture of fuel 18 and air 20 to generate hot combustion gases, which in turn drive a piston (e.g., reciprocating piston) within a cylinder liner. In particular, the hot combustion gases expand and exert a pressure against the piston that linearly moves the piston from a top portion to a bottom portion of the cylinder liner during an expansion stroke. The piston converts the pressure exerted by the combustion gases (and the piston's linear motion) into a rotating motion (e.g., via a connecting rod and a crank shaft coupled to the piston). The rotation of the crank shaft drives the electrical generator 16 to generate power or other power consumer. Alternatively, the crank shaft drives a mechanical drive 16. In certain embodiments, exhaust from the engine 12 may be provided to the turbocharger 14 and utilized in a turbine portion of the turbocharger 14, thereby driving a compressor of the turbocharger 14 to pressurize the air 20. In some embodiments, the power generation system 10 may not include all of the components illustrated in FIG. 1. In addition, the power generation system 10 may include additional components such as control components and/or heat recovery components. In certain embodiments, the turbocharger 14 may be utilized as part of the heat recovery components. The system 10 may generate power ranging from 10 kW to 10 MW or greater. Besides power generation, the system 10 may be utilized in other applications such as those that recover heat and utilize the heat (e.g., combined heat and power applications), combined heat, power, and cooling applications, applications that also recover exhaust components (e.g., carbon dioxide) for further utilization, gas compression applications, and mechanical drive applications.

Figure 2:
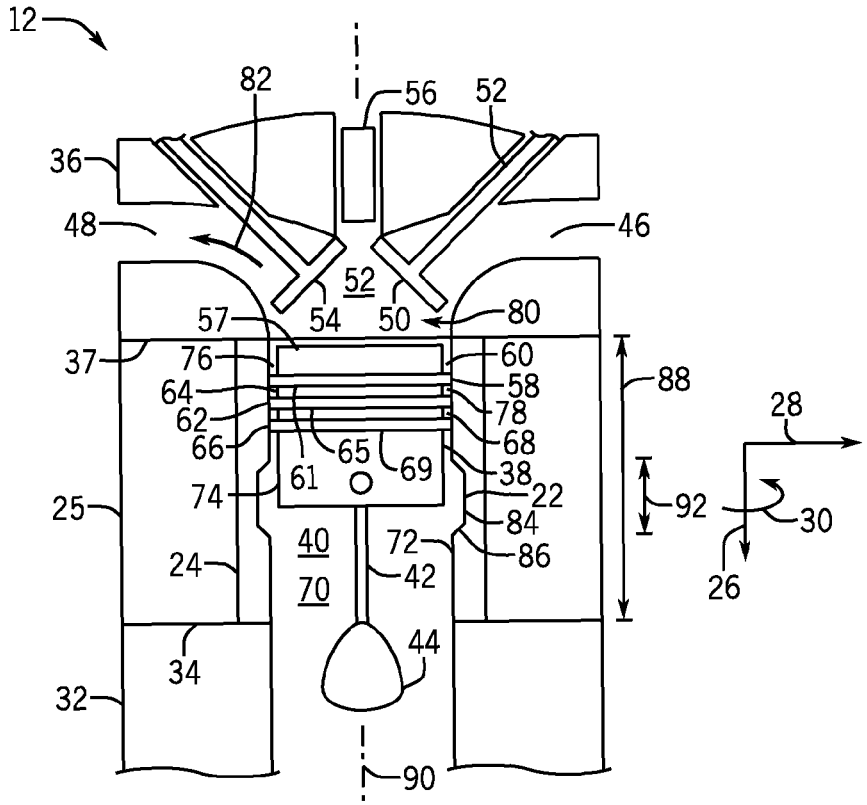
FIG. 2 is a cross-sectional side view of an embodiment of a reciprocating or piston engine of the power generation system of FIG. 1 having slots on a cylinder liner.

FIG. 2 is a cross-sectional side view of an embodiment of the reciprocating or piston engine 12 having a plurality of slots 22 on a cylinder liner 24. In the following discussion, reference may be made to longitudinal axis or direction 26, a radial axis or direction 28, and/or a circumferential axis or direction 30 of the engine 12. As mentioned above, in certain embodiments, the engine 12 may include multiple cylinders (e.g., 2, 4, 6, 8, 10, 12, 14, 16, 18, 20, 22, or 24 cylinders). The engine 12 includes a cylinder 25 having the cylinder liner 24, a crankcase 32 coupled to a bottom end 34 of the liner 24 and the cylinder 25, a cylinder head 36 coupled to a top end 37 of the liner 24 and the cylinder 25, a piston 38 disposed in a cavity 40 within the liner 24, and a connecting rod 42 coupled to the piston 38 within the liner 24 and to a crankshaft 44 within the crankcase 32. The cylinder head 36 includes an intake port 46 for receiving air or a mixture of fuel and air and an exhaust port 48 for discharging exhaust from the engine 12. An intake valve 50, disposed within the cylinder head 36 and the intake port 46, opens and closes to regulate the intake of air or the mixture of fuel and air into the engine 12 into a portion 52 of the cavity 40 above the piston 12. An exhaust valve 54, disposed within the exhaust port 48, opens and closes to regulate discharge of the exhaust from the engine 12. In certain embodiments (e.g., spark-ignition engine), a spark plug 56 extends through a portion of the cylinder head 36 and interfaces with the portion 52 of the cavity 40 where combustion occurs. In some embodiments (e.g., compression-ignition engine), the spark plug is absent (or is replaced with a glow plug) and ignition occurs primarily due to compression of the mixture of air and fuel.

The piston 38 includes a crown 57, a first ring 58 (e.g., annular compression ring) disposed beneath a top land 60 and within a first ring (e.g., top ring) groove 61 of the piston 38, a second ring 62 (e.g., annular compression ring) disposed beneath a second land 64 and within a second ring groove 65 of the piston 38, and a third ring 66 (e.g., annular oil ring) disposed beneath a third land 68 and within a third ring groove 69 of the piston 38. In certain embodiments, the rings 48, 62, 66 may include a height less than a height of their respective grooves 61, 65, 69 creating a respective gap between the ring 48, 62, 66 and adjacent lands above each respective ring 61, 65, and 69. The first and second rings 58, 62 seal the portion 52 (e.g., combustion chamber) of the cavity 40, so that gases do not transfer into a portion 70 of the cavity 40 below the piston 38 into the crankcase 32. The third ring 66 regulates the consumption of engine oil. An inner surface 72 of the liner 24 and an outer side surface 74 of the piston 38 (e.g., the top land 60 and the first ring groove 61) at the top land 60 define a top land cavity or crevice 76. Pressure within the portion 52 of the cavity 40 above the piston 38 generally maintains a boundary (generally extending from an uppermost portion of the crown 57 radially 28 toward the inner surface 72 of the liner 24) between the portion 52 of the cavity 40 and the top land cavity 76 to trap any fluid (e.g., gases such as unburned hydrocarbons) within the top land cavity 76. The first and second rings 58, 62, the inner surface 72 of the liner 24, and the outer side surface 74 of the piston 38 (e.g., including the second land 64 and the second ring groove 65) define an interring cavity or crevice 78 (i.e., cavity between the first and second rings 58, 62).

Opening of the intake valve 50 enables a mixture of fuel and air to enter the portion 52 of the cavity 70 above the piston 38 as indicated by arrow 80. With both the intake valve 50 and the exhaust valve 54 closed and the piston 38 near top dead center (TDC) (i.e., position of piston 38 furthest away from the crankshaft 44, e.g., near the top end 37 of the liner 24 or the cylinder 25), combustion of the mixture of air and fuel occurs due to spark ignition (in other embodiments due to compression ignition). Hot combustion gases expand and exert a pressure against the piston 38 that linearly moves the position of the piston 38 from a top portion (e.g., at TDC) to a bottom portion of the cylinder liner 24 (e.g., at bottom dead center (BDC) in direction 26, which is the position of the piston 38 closest to the crankshaft 44, e.g., near the bottom end 34 of the liner 24 or the cylinder 25) during an expansion stroke. The piston 38 converts the pressure exerted by the combustion gases (and the piston's linear motion) into a rotating motion (e.g., via the connecting rod 42 and the crank shaft 44 coupled to the piston 38) that drives one or more loads (e.g., electrical generator 16). When combustion starts and pressure in the portion 52 of the cavity 40 builds up, fluid (e.g., unburned fuel or hydrocarbons) can partially leak past the first and second rings 58, 62 resulting in the blowby of the fluid (e.g., unburned hydrocarbons) into the crankcase 32 during the expansion stroke. During the exhaust stroke, the piston 38 returns from BDC to TDC, while the exhaust valve 54 is open to enable exhaust to exit the engine 12 via the exhaust port 48.

The cylinder liner 24 includes the plurality of slots 22 disposed along the inner surface 72 of the liner 24. In certain embodiments, the plurality of slots 22 may be disposed along an inner surface of the cylinder 25 (if the cylinder 25 does not include the liner 24). In certain embodiments, the cylinder 25 may be made of grey cast iron (e.g., including graphite). In certain embodiments, the cylinder liner 24 may be made of nodular cast iron alloyed with metals such as chromium, vanadium, and molybdenum. In certain embodiments, the liner 24 may include a harder metal than the metal in the cylinder 25. As described in greater detail below in FIGS. 3-5, the first and second rings 58, 62, the interring cavity 78, and the top land cavity 76 interface with the plurality of slots 22 to enable scavenging of fluid (e.g., unburned fuel or hydrocarbons) from the interring cavity 78 to the portion 70 of the cavity 40 below the piston 38 and the crankcase 32 and scavenging of fluid (e.g., unburned fuel or hydrocarbons) from the top land cavity 76 to the interring cavity 78. The slots 22 in conjunction with the existing cavities or crevices (e.g., top land cavity 76 and interring cavity 78) and the pressure differentials within the cylinder liner 24 during the expansion stroke enables a reduction in THC emissions (e.g., by scavenging unburned hydrocarbons).

The number of slots 22 may range from 2 to 200, 2 to 50, 50 to 100, 100 to 150, or 150-200. The slots 22 may form a single row 84 disposed circumferentially 30 along the inner surface 72. In certain embodiments, the slots 22 are disposed at an axial region 86 along a longitudinal length or height 88 of the liner 24, where a cavity pressure (i.e., pressure of the portion 52 of the cavity 40 above the piston, p_Cyl (see FIG. 4)) is substantially equal (e.g., a difference of approximately 20 percent or less, approximately 15 percent or less, approximately 10 percent or less, or approximately 5 percent or less) to an interring cavity pressure of the interring cavity 78 (e.g., approximately at the halfway point of the expansion stroke). In certain embodiments, the slots 22 extend lengthwise (e.g., are elongated) in a direction parallel with a longitudinal axis 90 of the liner 24. In other embodiments, each slot 22 of the plurality of the slots 22 extends at an angle relative to the longitudinal axis 90 (see FIG. 6), where the angle is not 0 degrees. In certain embodiments, the angle of each slot may range from greater than 0 degrees to less than 180 degrees, between greater 0 degrees and approximately 45 degrees, between approximately 45 and 90 degrees, between approximately 90 and 135 degrees, or between approximately 135 degrees and less than 180 degrees, and all subranges therein. For example, the angle may be approximately 10, 20, 30, 40, 50, 60, 70, 80, 90, 100, 110, 120, 130, 140, 150, 160, or 170 degrees, or any other angle therebetween. In embodiments where the slots 22 are angled, the slots 22 may not overlap in the circumferential direction 30 about the longitudinal axis 90. In other embodiments where the slots 22 are angled, a first portion (e.g., portion nearest top end 37 of the liner 24) of each slot 22 may overlap with a second portion (e.g., portion nearest bottom end 34 of the liner 24) of adjacent slot 22 along the longitudinal axis 90 in the circumferential direction 30 (see FIG. 6). A height 92 of each slot 22 along the longitudinal axis 90 is of a distance that enables only a single ring of the first and single rings 58, 62 to interface with the slots 22 at a time to avoid fluids (e.g., unburned hydrocarbons or fuel) directly passing from the portion 52 of the cavity 40 above the piston 38 to the portion 70 of the cavity 40 below the piston 38 and the crankcase 32 or vice versa.

Figure 5:
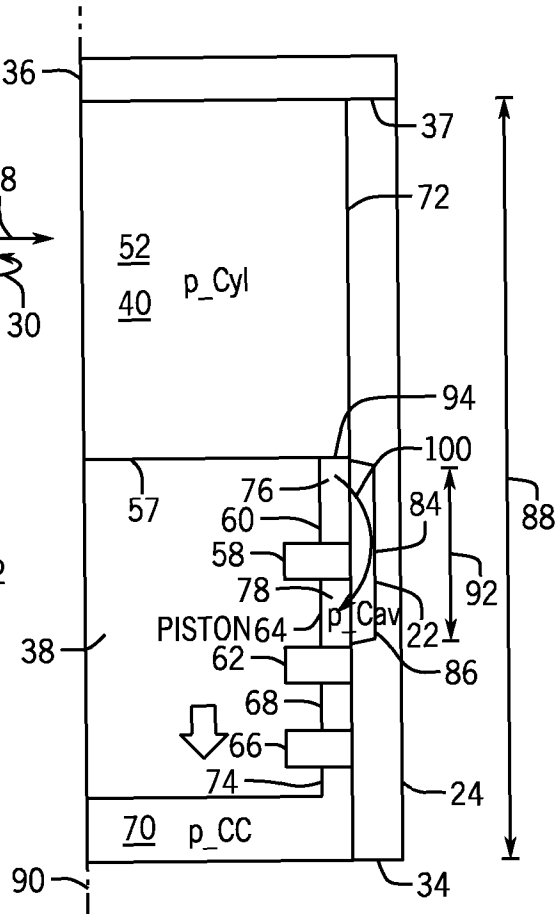
FIG. 5 is a cross-sectional side view of an embodiment of the cylinder liner of FIG. 2 and a piston disposed in the cylinder liner in a third position (e.g., slots open with respect to top land cavity or crevice and the interring cavity or crevice)
Figure 4:
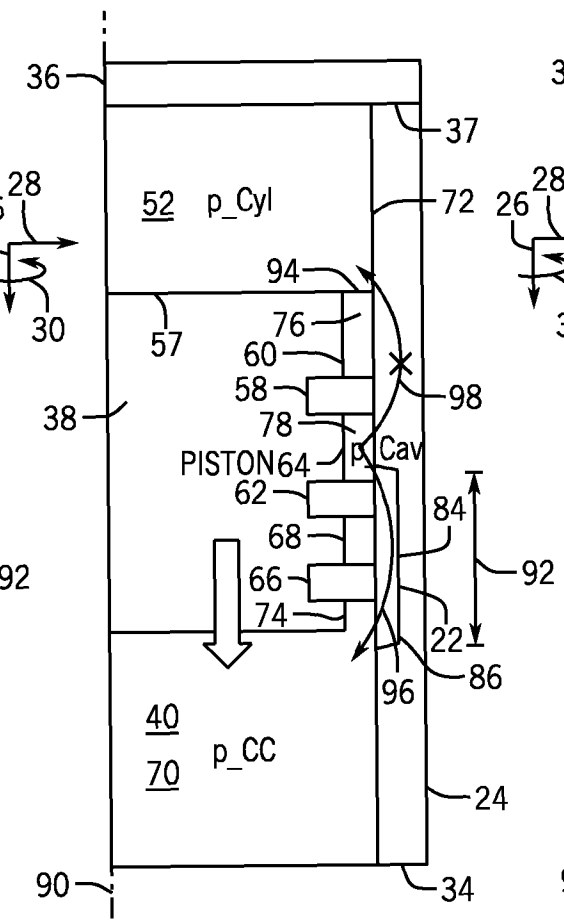
FIG. 4 is a cross-sectional side view of an embodiment of the cylinder liner of FIG. 2 and the piston disposed in the cylinder liner in a second position (e.g., slots open with respect to interring cavity or crevice)
Figure 3:
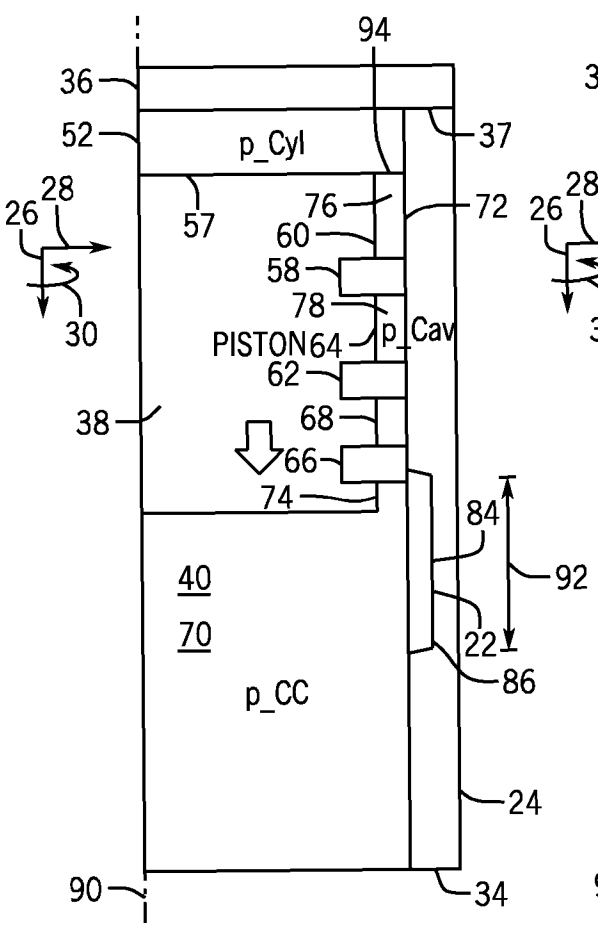
FIG. 3 is a cross-sectional side view of an embodiment of the cylinder liner of FIG. 2 and a piston disposed in the cylinder liner in a first position (e.g., slots closed with respect to piston crevices)

FIGS. 3-5 are partial cross-sectional side views of an embodiment of the engine 12 of FIG. 2, illustrating the positions of the piston 38 relative to the cylinder liner 24 during different portions of the expansion stroke. The piston 38, cylinder liner 24, and slots 22 in FIGS. 3-5 are as described above in FIG. 2. For simplicity, the rings 58, 62, 66 are not shown disposed circumferentially 30 completely about the piston 38. Also, the ring grooves 61, 65, 69 are not shown. In addition, the cylinder head 36 is shown in simplified form. Line 94 represents a boundary between the portion 52 of the cavity 40 above the piston 38 and the top land cavity 76. Also, in FIGS. 3-5, the pressure within the portion 52 of the cavity 40 above the piston is represented by p_Cyl (pressure of the cylinder), the pressure within the interring cavity 78 is represented by p_Cav, and the pressure of the portion 70 of the cavity 40 below the piston 38 is represented by p_CC (pressure of the crankcase 32).

FIG. 3 is a cross-sectional side view of an embodiment of the cylinder liner 24 of FIG. 2 and the piston 38 disposed in the cylinder liner 24 in a first position (e.g., slots 22 closed with respect to piston crevices, i.e., top land cavity 76 and interring cavity 78). This position of the piston 38 represents the start of the expansion stroke soon after combustion in the portion 52 (e.g., combustion region) of the cavity 40 above the piston 38, where the piston 38 is near TDC. In this position, neither the rings 58, 62 nor the top land cavity 76 and the interring cavity 78 interface with the slots 22. In other words, the slots 22 are closed with respect to the top land cavity 76 and the interring cavity 78 (i.e., fluid such as unburned hydrocarbons within the cavities 76, 78 does flow freely (without impediment) into the slots 22). During the start of combustion, the pressure within the portion 52 of the cavity 40 above the piston 38 (p_Cyl) builds up to a maximum combustion pressure. This increase in pressure pushes fluid (e.g., unburned fuel or hydrocarbons) past the rings 58, 62 and fills and pressurizes the cavities 76, 78. Also, a portion of the fluid flows into the portion 70 of the cavity 40 into the crankcase 32 resulting in blowby. In certain embodiments, the engine 12 may include a recirculation system to reutilize the unburned fuel from blowby as the fuel source for the engine 12. The pressure of the top land cavity 76 is less than p_Cyl but is greater than the p_Cav of the interring cavity 78 and p_CC in the portion 70 of the cavity 40 below the piston 38. The difference in pressures between p_Cyl and the pressure of the top land cavity 76 forms a boundary 94 that generally keeps the fluid (e.g., unburned fuel or hydrocarbons) within the interring cavity 78. The p_Cav of the interring cavity 78 is greater than p_CC. For example, at this stage, in certain embodiments, the p_Cav may be approximately 20 percent of the p_Cyl.

FIG. 4 is a cross-sectional side view of an embodiment of the cylinder liner 24 of FIG. 2 and the piston 38 disposed in the cylinder liner 24 in a second position (e.g., slots 22 open with respect to the interring cavity 78). This position of the piston 38 represents approximately halfway along the expansion stroke well after combustion in the portion 52 (e.g., combustion region) of the cavity 40 above the piston 38 has occurred. In this position, both the ring 58 and the top land cavity 76 do not interface with the slots 22. In other words, the slots 22 are closed with respect to the top land cavity 76 (i.e., fluid such as unburned hydrocarbons within the cavity 76 does not flow freely (without impediment) into the slots 22). Both the ring 62 and the interring cavity 78 interface with the slots 22. In other words, the slots 22 are open with respect to the interring cavity 78. This enables fluid (e.g., unburned hydrocarbons or fuel) to freely flow (without impediment) through the slots 22 into the portion 70 of the cavity 40 below the piston 38 and into the crankcase 32 (e.g., as additional blowby) to be scavenged as indicated by arrow 96. Since the ring 58 still interfaces with the inner surface 72 of the cylinder liner 24 but does not interface with the slots 22, the ring 58 blocks backflow of fluid (e.g., unburned fuel or hydrocarbons) into the portion 52 of the cavity 40 above the piston 38 (as indicated by blocked arrow 98) and subsequently into the exhaust port 48 (e.g., during the exhaust stroke) to become THC emissions. As mentioned above, in certain embodiments, the engine 12 may include a recirculation system to reutilize the unburned fuel from blowby as an addition to the fuel source for the engine 12. Also, as mentioned above, the height 92 of each slot 22 along the longitudinal axis 90 is of a distance that enables only a single ring of the first and single rings 58, 62 to interface with the slots 22 at a time to avoid fluids (e.g., unburned hydrocarbons or fuel) directly passing from the portion 52 of the cavity 40 above the piston 38 to the portion 70 of the cavity 40 below the piston 38 and the crankcase 32 or vice versa. At this point, p_Cyl is less compared to p_Cyl during the beginning of the expansion stroke in FIG. 3, but still greater than p_CC. Just prior to the interring cavity 78 interfacing with the slots 22 (i.e., the slots 22 being open to cavity 78), the p_Cyl is slightly greater than or substantially equal (e.g., a difference of approximately 20 percent or less, approximately 15 percent or less, approximately 10 percent or less, or approximately 5 percent or less) to p_Cav. Also, the pressure within the top land cavity 76 is about the same as p_Cyl and p_Cav is significantly greater than p_CC. The pressure difference between p_Cav and p_CC causes the flow of fluid from the interring cavity 78 to the portion 70 of the cavity 40 below the piston 38 upon opening of the slots 22 to the interring cavity 78. With flow of fluid from the interring cavity 78 through the slots 22 into the portion 70 of the cavity 40 below the piston 38 upon opening the slots 22 with respect to the interring cavity 78, p_Cav approaches p_CC. After the flow of fluid from the interring cavity 78 into the portion 70 of the cavity 40 below the piston 38, the pressure of the top land cavity 76 becomes significantly greater than both p_Cav of the interring cavity 78 and p_CC in the portion 70 of the cavity 40 below the piston 38.

As depicted, the third land 68 is shown interfacing with the slots 22. In certain embodiments, the slots 22 may be sized such that when the interring cavity 78 interfaces with the slots 22, a cavity defined by the outer side surface 74 of the piston 38, the third ring groove 69, the second ring 62, and the third ring 66 does not interface with the slots 22 (i.e., slots 22 are closed with respect to this cavity).

FIG. 5 is a cross-sectional side view of an embodiment of the cylinder liner 24 of FIG. 2 and the piston 38 disposed in the cylinder liner 24 in a third position (e.g., slots 22 open with respect to top land cavity 76). This position of the piston 38 represents a latter portion (e.g., beyond halfway) of the expansion stroke, where the piston 38 is approaching BDC. In this position, the ring 62 does not interface with the slots 22 blocking any further backflow of fluid (e.g., unburned fuel or hydrocarbons) into the portion 70 of the cavity 40 and the crankcase 32. The ring 58 and both the interring cavity 78 and the top land cavity 76 interface with the slots 22. In other words, the slots 22 are open with respect to both the interring cavity 78 and the top land cavity 76. This enables fluid (e.g., unburned hydrocarbons or fuel) to freely flow (without impediment) from the top land cavity 76 (due to the pressure differential between the cavities 76, 78 noted above) through the slots 22 into the interring cavity 78 as indicated by arrow 100. The fluid (e.g., unburned fuel) transferred to the interring cavity 78 from the top land cavity 76 may be scavenged in a subsequent expansion stroke. Also, during the exhaust stroke in a direction opposite to direction 26, the ring 58 will become closed with respect to the slots 22 maintaining the fluid (e.g., unburned fuel) in the interring cavity 78 and blocking backflow of the fluid into the portion 52 of the cavity 40 above the piston 38 (as indicated by blocked arrow 98) and subsequently into the exhaust port 48 (e.g., during the exhaust stroke) to become THC emissions. Just prior to the top land cavity 76 interfacing with the slots 22 (i.e., the slots 22 being open to cavity 76), p_Cyl and the pressure within the top land cavity 76 are significantly greater than both p_Cav and p_CC. Just prior to the opening of the slots 22 to the top land cavity 76, p_Cav is slightly greater than or substantially equal (e.g., a difference of approximately 20 percent or less, approximately 15 percent or less, approximately 10 percent or less, or approximately 5 percent or less) to p_CC. The pressure difference between the pressure within the top land cavity 76 and p_Cav causes the flow of fluid from the top land cavity 76 to the interring cavity 78 upon opening of the slots 22 to the top land cavity 76. With flow of fluid from the top land cavity 76 into the interring cavity 78 through the slots 22, p_Cyl and the pressure within the top land cavity 76 is slightly greater or substantially equal (e.g., a difference of approximately 20 percent or less, 15 percent or less, 10 percent or less, or approximately 5 percent or less) to p_Cav. At this point, both p_Cyl, the pressure within the top land cavity 78, and p_Cav become greater than p_CC. As noted above, in certain embodiments, the slots 22 are disposed at an axial region 84 along the longitudinal length 88 of the liner 24, where the p_Cyl is substantially equal (e.g., a difference of approximately 20 percent or less, 15 percent or less, 10 percent or less, or approximately 5 percent or less) to the p_Cav (e.g., approximately at the halfway point of the expansion stroke) just prior to the interring cavity 78 interfacing with the slots 22 as noted above.

Figure 6:
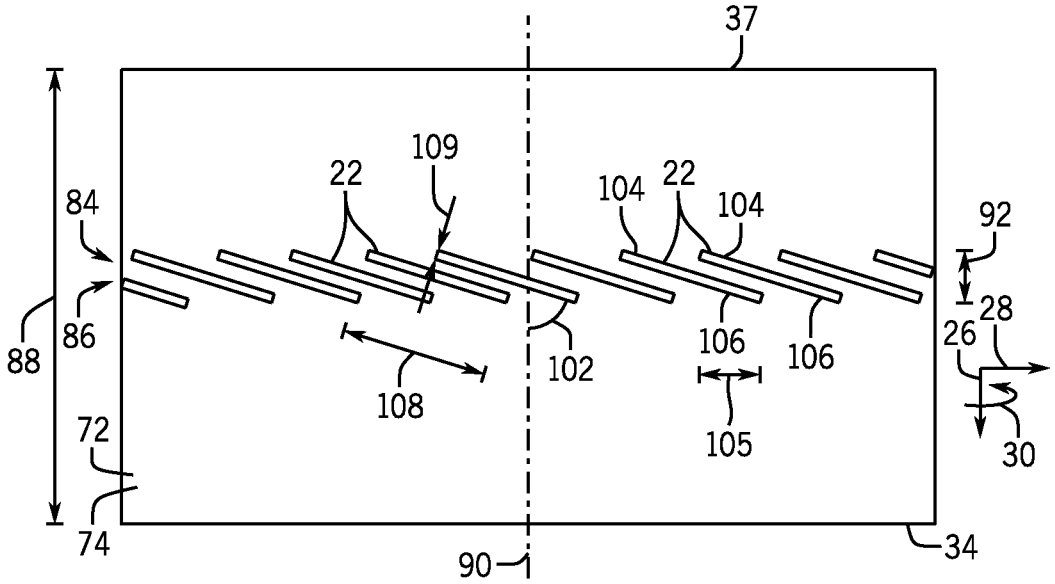
FIG. 6 is a diagrammatical view of an embodiment of slots (e.g., angled slots) on an inner surface of a cylinder liner.

FIG. 6 is a diagrammatical view of an embodiment of the slots 22 (e.g., angled slots) on the inner surface 72 of the cylinder liner 24. The number of slots 22 may range from 2 to 200, 2 to 50, 50 to 100, 100 to 150, or 150-200. As depicted, the slots 22 form a single row 84 disposed circumferentially along the inner surface 72. As depicted the slots 22 may be uniformly disposed circumferentially along the inner surface 72. In other embodiments, the slots may not be unformed disposed or spaced circumferentially along the inner surface 72. In some embodiments, the cylinder liner 24 may include more than one row of slots 22. In certain embodiments, the slots 22 are disposed at the approximate point 86 along the longitudinal length 88 of the liner 24, where p_Cyl is substantially equal (e.g., a difference of approximately 20 percent or less, approximately 15 percent or less, approximately 10 percent or less, or approximately 5 percent or less) to p_Cav of the interring cavity 78 (e.g., approximately at the halfway point of the expansion stroke). As depicted, each slot 22 of the plurality of the slots 22 extends at an angle 102 relative to the longitudinal axis 90 of the liner 24, where the angle is not 0 degrees. In certain embodiments, the angle 102 of each slot 22 may range from greater than 0 degrees to less than 180 degrees, between greater 0 degrees and approximately 45 degrees, between approximately 45 and 90 degrees, between approximately 90 and 135 degrees, or between approximately 135 degrees and less than 180 degrees, and all subranges therein. For example, the angle may be approximately 10, 20, 30, 40, 50, 60, 70, 80, 90, 100, 110, 120, 130, 140, 150, 160, or 170 degrees, or any other angle therebetween. As depicted, a first portion 104 (e.g., portion nearest top end 37 of the liner 24) of each slot 22 may overlap with a second portion 106 (e.g., portion nearest bottom end 34 of the liner 24) of adjacent slot 22 along the longitudinal axis 90 in the circumferential direction 30. In other embodiments where the slots 22 are angled, the slots 22 may not overlap in the circumferential direction 30 about the longitudinal axis 90. In other embodiments where the slots 22 are angled, the first portion 104 (e.g., portion nearest top end 37 of the liner 24) of each slot 22 may not overlap (e.g., no circumferential overlap 105) with a second portion 106 (e.g., portion nearest bottom end 34 of the liner 24) of adjacent slot 22 along the longitudinal axis 90 in the circumferential direction 30. As depicted, the slots 22 overlap axially (e.g., completely axially overlap along height 92) in the longitudinal direction 26.

The slots 22 are sized and positioned so that the rings 58, 62, and 66 do not fall or enter (e.g., radially 28) into the slots 22. Each slot 22 includes a length 108, a width 109, and the height 92. As depicted, the slots 22 have a rectilinear shape. In certain embodiments, the slots 22 may include a curved shape, or any other shape, or include a variable width. In certain embodiments, a length to width ratio for slots 22 may be, for example, 1.5:1 to 15:1, 2:1 to 10:1, or 3:1 to 5:1. In embodiments with angled slots 22, the length 108 of each slot 22 is greater than the height 92. In embodiments where the slots 22 extend in a direction parallel with the longitudinal axis 90 of the liner 24, the length 108 and the height 92 may be the same. The height 92 of each slot 22 along the longitudinal axis 90 is of a distance that enables only a single ring of the first and single rings 58, 62 to interface with the slots 22 at a time to avoid fluids (e.g., unburned hydrocarbons or fuel) directly passing from the portion 52 of the cavity 40 above the piston 38 to the portion 70 of the cavity 40 below the piston 38 and the crankcase 32 or vice versa. In certain embodiments, a total volume of all of slots 22 (which is equivalent to a scavenging volume) is greater than or equal to a difference in a volume of the top land cavity 76 and a volume of the interring cavity 78. In certain embodiments, the volume of the top land cavity 76 is large enough to enable evacuation of the fluid (e.g., unburned fuel or hydrocarbons) into the interring cavity 78 when the slots 22 are open with respect to both cavities 76, 78.

Figure 7:
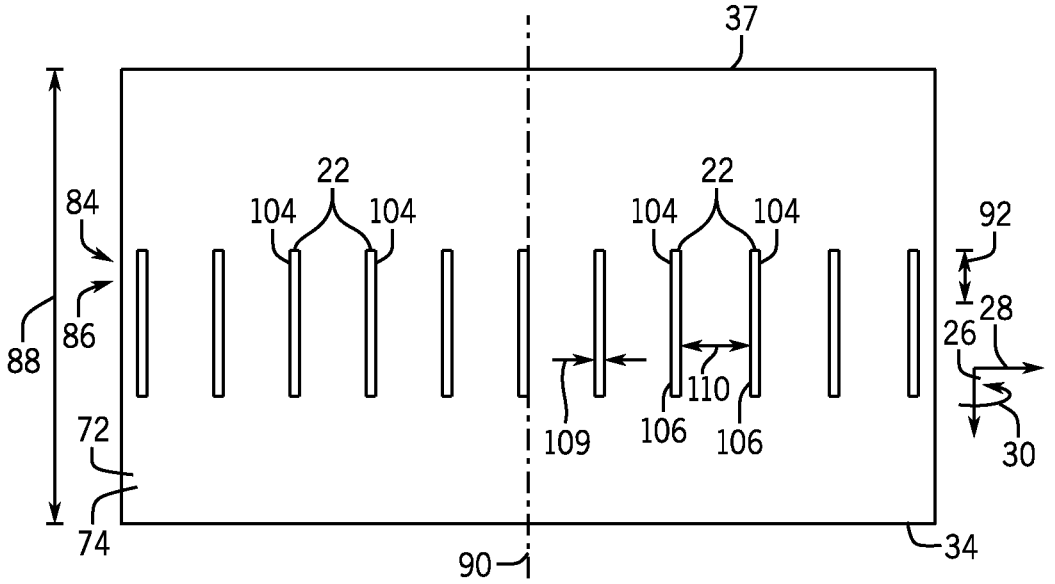
FIG. 7 is a diagrammatical view of an embodiment of slots (e.g., non-angled slots) on an inner surface of a cylinder liner.

FIG. 7 is a diagrammatical view of an embodiment of the slots 22 (e.g., non-angled slots) on the inner surface 24 of the cylinder liner 24. The slots 22 are as described in FIG. 6 except the slots 22 are parallel with the longitudinal axis 90 of the cylinder liner 24 (and not angled with respect to the longitudinal axis 90). As a result, the slots 22 include a gap 110 between them in the longitudinal direction 26.

Technical effects of the disclosed embodiments include providing systems for reducing THC emissions (e.g., due to unburned hydrocarbons). In particular, embodiments include the reciprocating engine 12 that includes the cylinder liner 24 having the inner surface 72 that includes multiple slots 22 (e.g., piston crevice scavenging control slots). The slots 22 function with the existing cavities or crevices (e.g., top land cavity 76 and interring cavity 78) and the pressure differentials within the cylinder liner 24 during the expansion stroke to scavenge unburned fuel from the interring cavity 78 into the crankcase 32 and unburned fuel from the top land cavity 76 into the interring cavity 78. Besides scavenging unburned fuel, backflow into the engine exhaust during the exhaust stroke may be reduced. This may enable a reduction in THC emissions and improve engine efficiency. Also, due to the reduction in THC emissions, the need for or size of aftertreatment systems to achieve desired engine out THC emissions may be reduced.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. A reciprocating engine, comprising:

a cylinder liner having an inner surface that defines a cavity, wherein the cylinder liner comprises a plurality of slots disposed along a portion of the inner surface;

a piston disposed within the cylinder liner, wherein the piston is configured to move between a first position and a second position; and a first ring disposed about the piston beneath a top land of the piston, wherein the first ring, the top land, a first ring groove of the piston, and the inner surface of the cylinder liner define a top land cavity having a first volume; and a second ring disposed about the piston below the first ring and a second land of the piston, wherein the first and second rings, the second land, a second ring groove of the piston, and the inner surface of the cylinder liner define an interring cavity having a second volume, wherein a total volume of the plurality of slots is greater than or equal to a difference between the first volume of the top land cavity and the second volume of the interring cavity;

wherein in the first position the first and second rings, the top land cavity, and the interring cavity do not interface with the plurality of slots, and in the second position either the first ring or the second ring and at least one of the top land cavity or the interring cavity interface with the plurality of slots.

2. The reciprocating engine of claim 1, wherein in the second position the second ring and the interring cavity interface with the plurality of slots, and the first ring and the top land cavity do not interface with the plurality of slots.

3. The reciprocating engine of claim 2, wherein in the second position the interface between the interring cavity and the plurality of slots is configured to enable fluid within the interring land cavity to flow into the plurality of slots and into a portion of the cavity below the piston.

4. The reciprocating engine of claim 1, wherein in the second position the first ring, the interring cavity, and the top land cavity interface with the plurality of slots, and the second ring does not interface with the plurality of slots.

5. The reciprocating engine of claim 4, wherein in the second position the interface between the top land cavity and the plurality of slots is configured to enable fluid within the top land cavity to flow into the plurality of slots and into the interring cavity.

6. The reciprocating engine of claim 1, wherein the piston is configured to move to a third position, wherein in the second position the second ring and the interring cavity interface with the plurality of slots, and the first ring and the top land cavity do not interface with the plurality of slots, and wherein in the third position the first ring, the interring cavity, and the top land cavity interface with the plurality of slots, and the second ring does not interface with the plurality of slots.

7. The reciprocating engine of claim 6, wherein movement from the second position to the third position during an expansion stroke of the piston is configured to trap unburned fuel previously in the top land cavity in the interring cavity to reduce flow of unburned fuel into a portion of the cavity above the piston.

8. The reciprocating engine of claim 6, wherein the plurality of slots are arranged in a single row disposed circumferentially along the portion of the inner surface of the cylinder liner, and wherein the plurality of slots are disposed at an axial region along a longitudinal length of the cylinder liner where a first cavity pressure within a first portion of the cavity of the cylinder liner above the piston is substantially equal to an interring cavity pressure of the interring cavity during an expansion stroke of the piston.

9. The reciprocating engine of claim 8, wherein in the first position during the expansion stroke the first cavity pressure within the first portion of the cavity of the cylinder liner above the piston is configured to be greater than the interring cavity pressure of the interring cavity.

10. The reciprocating engine of claim 8, wherein just prior to the second position during the expansion stroke the first cavity pressure within the first portion of the cavity of the cylinder liner above the piston is configured to be substantially equal to the interring cavity pressure of the interring cavity.

11. The reciprocating engine of claim 8, wherein just prior to the third position during the expansion stroke the interring cavity pressure of the interring cavity is configured to be substantially equal to a second cavity pressure within a second portion of the cavity of the cylinder liner below the piston.

12. The reciprocating engine of claim 8, wherein each slot of the plurality of slots extends in a direction parallel with a longitudinal axis of the cylinder liner.

13. The reciprocating engine of claim 8, wherein each slot of the plurality of slots extends at an angle relative to a longitudinal axis of the cylinder liner, and the angle is between 0 degrees and 180 degrees.

14. The reciprocating engine of claim 13, wherein each slot of the plurality of slots comprises a first portion and a second portion, and the first portion of each slot of the plurality of slots overlaps with the second portion of an adjacent slot of the plurality of slots along the longitudinal axis in a circumferential direction.

15. The reciprocating engine of claim 1, comprising a third ring disposed about the piston below the first ring and the second ring, wherein at least a portion of the plurality of slots is disposed below the third ring when the piston is in the first position, the second position, or combination thereof.

16. A system, comprising:

a cylinder liner configured to mount in a reciprocating engine, wherein the cylinder liner comprises an inner surface that defines a cavity, the cylinder liner comprises a plurality of slots disposed along a portion of the inner surface, the cylinder liner is configured to receive a piston within the cavity, the plurality of slots are disposed at an axial region along a longitudinal length of the cylinder liner where a cavity pressure within a first portion of the cavity of the cylinder liner above the piston is configured to be substantially equal to an interring cavity pressure of an interring cavity during an expansion stroke of the piston, and the interring cavity is defined by an outer surface of the piston, first and second rings disposed about the piston, and the inner surface of the cylinder liner, and wherein a total volume of the plurality of slots is greater than or equal to a difference between a first volume of a top land cavity of the piston and a second volume of the interring cavity.

17. The system of claim 16, wherein the plurality of slots are arranged in a single row disposed circumferentially along the portion of the inner surface of the cylinder liner.

18. The system of claim 17, wherein each slot of the plurality of slots extends in a direction parallel with a longitudinal axis of the cylinder liner.

19. The system of claim 16, wherein at least a portion of the plurality of slots is located below a third ring disposed about the piston, wherein the third ring is located below the first and second rings.

20. A reciprocating engine, comprising:

a cylinder liner having an inner surface that defines a cavity, wherein the cylinder liner comprises a plurality of slots disposed along a portion of the inner surface;

a piston disposed within the cylinder liner, wherein the piston is configured to move between a first position, a second position, and a third position; and a first ring disposed about the piston beneath a top land of the piston, wherein the first ring, the top land, a first ring groove of the piston, and the inner surface of the cylinder liner define a top land cavity; and a second ring disposed about the piston below the first ring and a second land of the piston, wherein the first and second rings, the second land, a second ring groove of the piston, and the inner surface of the cylinder liner define an interring cavity;

wherein in the first position neither a first fluid within the top land cavity nor a second fluid within the interring cavity is enabled to flow into the plurality of slots, in the second position the first fluid within the top land cavity is not enabled to flow into the plurality of slots and the second fluid within the interring cavity is enabled to flow into the plurality of slots and into a portion of the cavity below the piston, and in the third position the first fluid within the top land cavity is enabled to flow into the plurality of slots and into the interring cavity and is not enabled to flow into a portion of the cavity below the piston.

* * * * *

UNITED STATES PATENT AND TRADEMARK OFFICE

CERTIFICATE OF CORRECTION

PATENT NO. : 9,194,327 B2
APPLICATION NO. : 14/246301
DATED : November 24, 2015
INVENTOR(S) : Hillebrecht et al.

It is certified that error appears in the above-identified patent and that said Letters Patent is hereby corrected as shown below:

On the title page item (72), Line 2, delete "Rlchard" and insert -- Richard --, therefor.

Signed and Sealed this
Twenty-first Day of June, 2016

Michelle K. Lee

Michelle K. Lee
*Director of the United States Patent and Trademark Office*